US011151950B2

(12) United States Patent
Chen et al.

(10) Patent No.: US 11,151,950 B2
(45) Date of Patent: Oct. 19, 2021

(54) LIGHT-EMITTING DEVICE AND DISPLAY EQUIPMENT RELATED TO VARIABLE OPERATION VOLTAGE USED FOR REDUCING POWER CONSUMPTION

(71) Applicant: InnoLux Corporation, Miao-Li County (TW)

(72) Inventors: Liang-Lu Chen, Miao-Li County (TW); Chin-Lung Ting, Miao-Li County (TW); Ker-Yih Kao, Miao-Li County (TW); Li-Wei Mao, Miao-Li County (TW); Ming-Chun Tseng, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/847,575

(22) Filed: Apr. 13, 2020

(65) Prior Publication Data

US 2020/0357347 A1 Nov. 12, 2020

Related U.S. Application Data

(60) Provisional application No. 62/844,752, filed on May 8, 2019.

(30) Foreign Application Priority Data

Jan. 16, 2020 (CN) ..... 202010047807.6

(51) Int. Cl.
*G09G 3/34* (2006.01)
*G09G 3/36* (2006.01)

(52) U.S. Cl.
CPC ..... *G09G 3/342* (2013.01); *G09G 3/36* (2013.01); *G09G 2300/0426* (2013.01); *G09G 2300/0809* (2013.01); *G09G 2320/0233* (2013.01); *G09G 2320/0626* (2013.01); *G09G 2330/021* (2013.01)

(58) Field of Classification Search
CPC ..... G09G 3/36; G09G 3/20; G09G 2310/08; G09G 2320/0626; G09G 2330/021; G09G 3/34
See application file for complete search history.

(56) References Cited

U.S. PATENT DOCUMENTS 7,286,123 B2 * 10/2007 Yang ..... G09G 3/2014 315/291
2003/0203523 A1 * 10/2003 Yamazaki ..... H05B 45/395 438/22

(Continued)

FOREIGN PATENT DOCUMENTS

CN 101989402 A 3/2011
CN 104658485 A 5/2015

*Primary Examiner* — Olga V Merkoulova
(74) *Attorney, Agent, or Firm* — Winston Hsu

(57) ABSTRACT

A light-emitting device and display equipment are disclosed. The light-emitting device includes a light-emitting unit. The light-emitting unit includes a driving transistor and a light-emitting diode. The driving transistor includes a first terminal, a second terminal and a gate terminal. The first terminal is used to receive an operation voltage. The light-emitting diode is coupled to the second terminal and used to receive a driving current. The operation voltage is variable.

16 Claims, 5 Drawing Sheets

(56) References Cited

U.S. PATENT DOCUMENTS

| | | | | |
|---|---|---|---|---|
| 2004/0135749 | A1* | 7/2004 | Kondakov | G09G 3/3208 345/82 |
| 2004/0263444 | A1* | 12/2004 | Kimura | G09G 3/3275 345/82 |
| 2008/0024528 | A1* | 1/2008 | Han | G09G 3/3413 345/690 |
| 2008/0170054 | A1 | 7/2008 | Chou | |
| 2008/0284702 | A1* | 11/2008 | Shidara | G09G 3/20 345/90 |
| 2009/0058769 | A1* | 3/2009 | Kawabe | G09G 3/2074 345/76 |
| 2009/0096723 | A1* | 4/2009 | Kawabe | G09G 3/3258 345/77 |
| 2009/0102759 | A1* | 4/2009 | Kawabe | G09G 3/3258 345/76 |
| 2009/0201281 | A1* | 8/2009 | Routley | G09G 3/3233 345/212 |
| 2011/0025676 | A1* | 2/2011 | Kawashima | G09G 3/3233 345/212 |
| 2013/0082910 | A1 | 4/2013 | Lee | |
| 2014/0354624 | A1 | 12/2014 | Chaji | |
| 2016/0286622 | A1 | 9/2016 | Gai | |
| 2018/0025690 | A1* | 1/2018 | Bao | G09G 3/3233 345/691 |
| 2018/0090067 | A1* | 3/2018 | Oh | G09G 3/3225 |
| 2019/0318692 | A1* | 10/2019 | Jiang | H01L 27/326 |
| 2020/0219435 | A1* | 7/2020 | Chen | G09G 3/3233 |

* cited by examiner

LIGHT-EMITTING DEVICE AND DISPLAY EQUIPMENT RELATED TO VARIABLE OPERATION VOLTAGE USED FOR REDUCING POWER CONSUMPTION

CROSS REFERENCE TO RELATED APPLICATION

This application claims priority to provisional Patent Application No. 62/844,752, filed 2019 May 8, and incorporated herein by reference in its entirety.

BACKGROUND OF THE DISCLOSURE

1. Field of the Disclosure

The disclosure relates to a light-emitting device and a display equipment, and more particularly, a light-emitting device and a display equipment related to a variable operation voltage.

2. Description of the Prior Art

Electronic products have become indispensable necessities in modern society. With the rapid development of these electronic products, consumers have high expectations for the quality, function or price of these products.

Although some electronic products can emit light or display images, they still have problems such as insufficient brightness or poor display quality.

SUMMARY OF THE DISCLOSURE

An embodiment provides a light-emitting device including a light-emitting unit. The light-emitting unit includes a driving transistor and a light-emitting diode. The driving transistor includes a first terminal, a second terminal and a gate terminal. The first terminal is used to receive an operation voltage. The light-emitting diode is coupled to the second terminal and used to receive a driving current. The operation voltage is variable.

Another embodiment provides display equipment including a light-emitting device and a liquid crystal panel. The light-emitting device includes a light-emitting unit. The light-emitting unit includes a driving transistor and a light-emitting diode. The driving transistor includes a first terminal, a second terminal and a gate terminal. The first terminal is used to receive an operation voltage. The light-emitting diode is coupled to the second terminal and used to receive a driving current. The liquid crystal panel is disposed above the light-emitting device. The operation voltage is variable.

These and other objectives of the present disclosure will no doubt become obvious to those of ordinary skill in the art after reading the following detailed description of the embodiment that is illustrated in the various figures and drawings.

DETAILED DESCRIPTION

Here in the text, terms such as "about", "approximately" and "substantially" usually indicate that a difference between a real value and a described value is within a ratio of the described value; for example, the ratio may be within 20%. For example, the ratio may be 10%, 5%, 3%, 2% 1% or 0.5%. Here in the text, a described value may be an approximate value; that is, without mentioning terms such as "about", "approximately" and "substantially", a described value may still be an approximate value.

Figure 1:
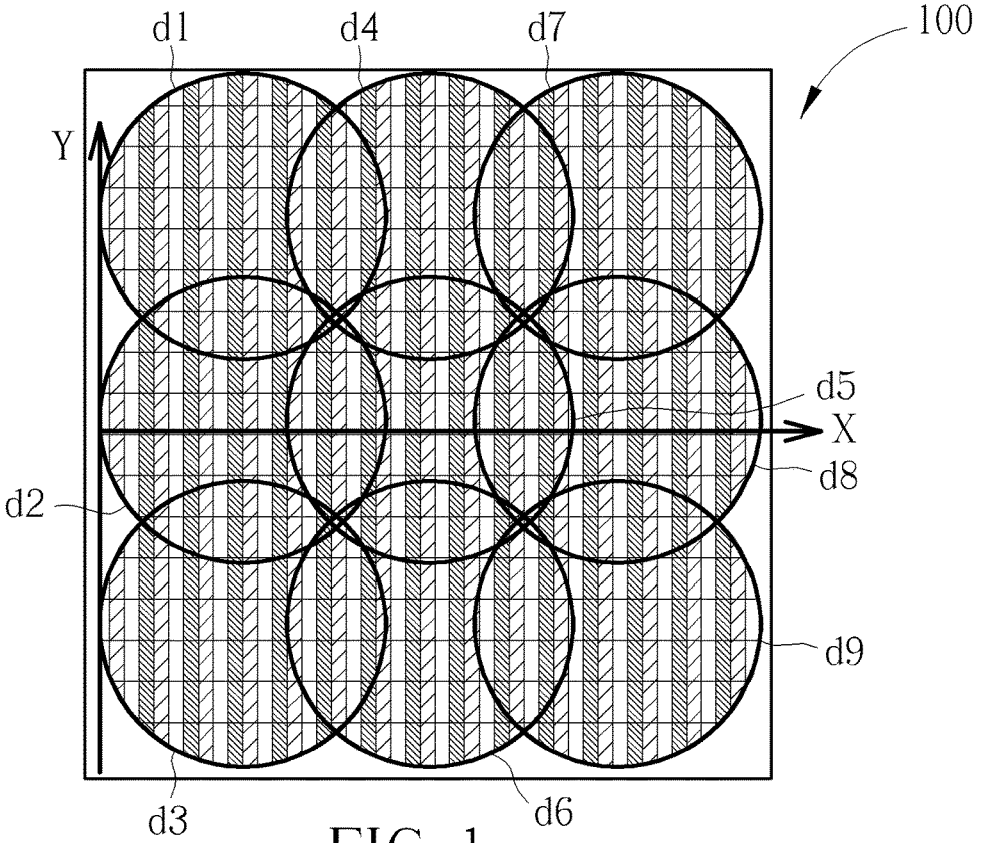
FIG. 1 illustrates a display device operated in a normal mode.
Figure 2:
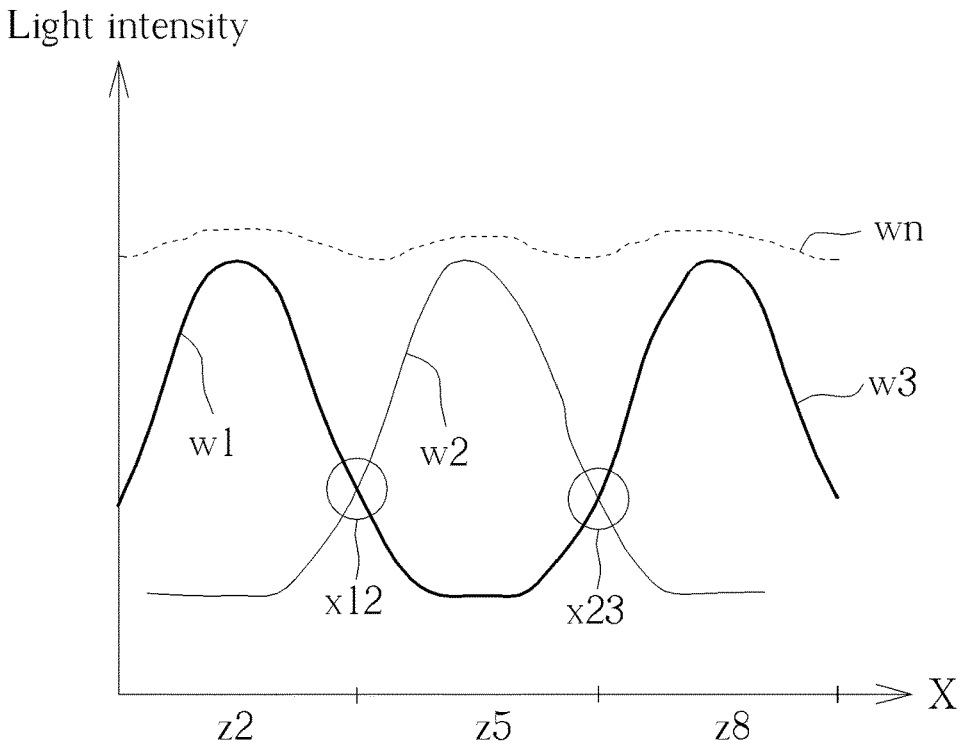
FIG. 2 illustrates a light intensity diagram in the normal mode of FIG. 1.
Figure 3:
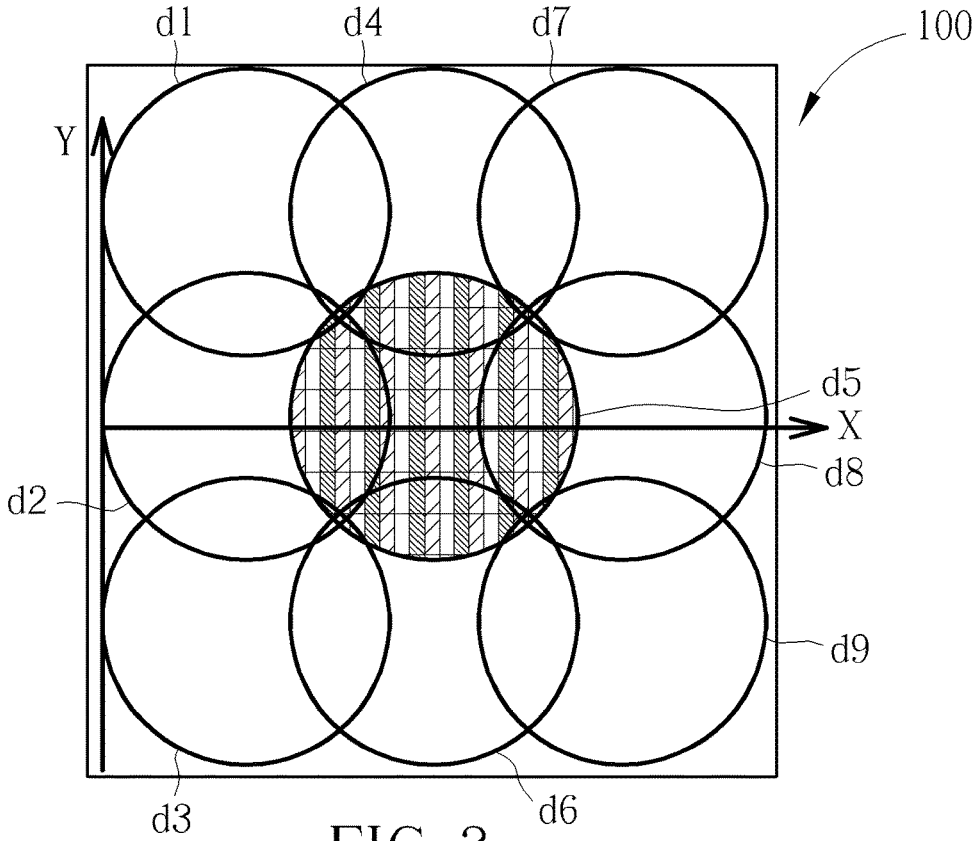
FIG. 3 illustrates the display device operated in a peak mode.
Figure 4:
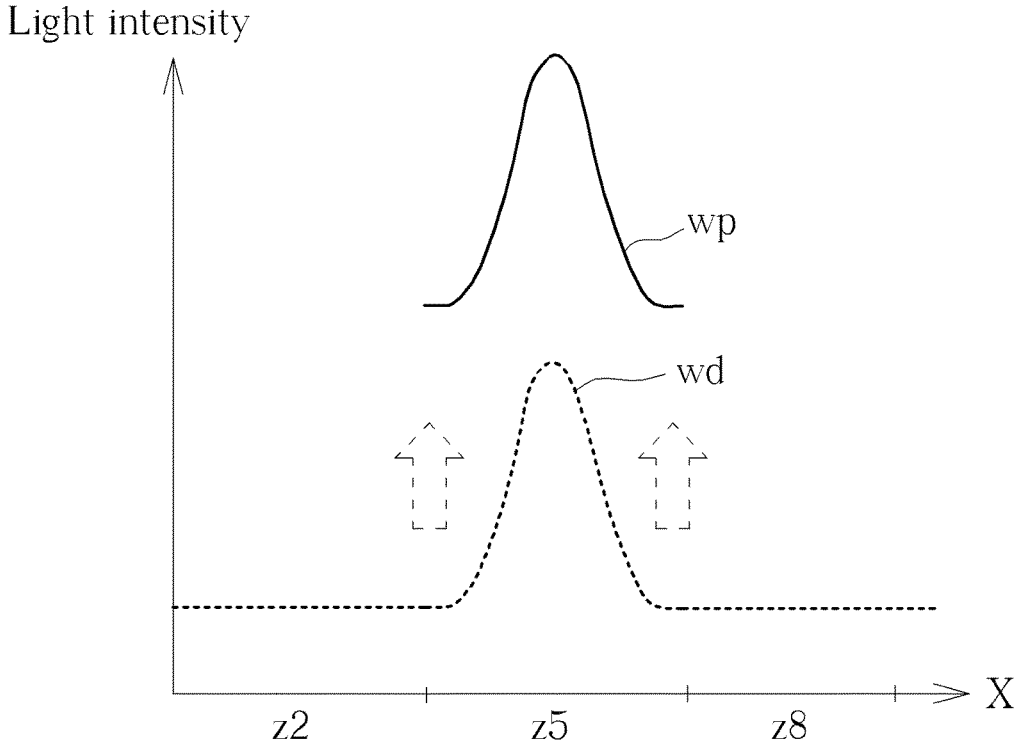
FIG. 4 illustrates a light intensity diagram in the peak mode of FIG. 3.

FIG. 1 illustrates a display device 100 operated in a normal mode. FIG. 2 illustrates a light intensity diagram in the normal mode of FIG. 1. FIG. 3 illustrates the display device 100 operated in a peak mode. FIG. 4 illustrates a light intensity diagram in the peak mode of FIG. 3.

As shown in FIG. 1 and FIG. 3, in the display device 100, a dimming zone d1 to a dimming zone d9 may be arranged and planned in coordinates defined by a horizontal axis X and a vertical axis Y. Along the horizontal axis X, the dimming zone d2, the dimming zone d5 and the dimming zone d8 may be respectively corresponding to a zone z2, a zone z5 and a zone z8. Each dimming zone shown in FIG. 1 and FIG. 3 may be corresponding to one pixel or a plurality of pixels.

In FIG. 2 and FIG. 4, the horizontal axis is corresponding to the horizontal X in FIG. 1, and the vertical axis is corresponding to the light intensity.

As shown in FIG. 1, when the dimming zone d1 to the dimming zone d9 are all emitting light, the display device 100 may be operated in the normal mode. In the normal mode, the light emitted by the dimming zone d2 may be corresponding to a light intensity waveform w1 in the zone z2; the light emitted by the dimming zone d5 may be corresponding to a light intensity waveform w2 in the zone z5; and the light emitted by the dimming zone d8 may be corresponding to a light intensity waveform w3 in the zone z8.

As shown in FIG. 1 and FIG. 2, the light emitted by the dimming zone d2, the dimming zone d5 and the dimming zone d8 may be corresponding to a light intensity waveform wn along the axis X. The light intensity waveform wn may be generated according to the light intensity waveform w1, the light intensity waveform w2 and the light intensity waveform w3. For example, the light intensity waveform wn may be generated by summing up the light intensity waveform w1, the light intensity waveform w2 and the light intensity waveform w3 with consideration of the optical mechanical design and optical components. As shown in FIG. 2, at a junction x12 of the zone z2 and the zone z5, although the light intensities expressed by the light intensity waveform w1 and the light intensity waveform w2 have respectively been reduced from maximum light intensities expressed by the two waveforms, the light intensity expressed by the light intensity waveform wn at the junction x12 may not be excessively reduced by adding the light intensities expressed by the light intensity waveform w1 and the light intensity waveform w2. Likewise, at a junction x23 of the zone z5 and the zone z8, the light intensity expressed by the light intensity waveform wn may not be excessively reduced. Hence, around the junction x23 of the zone z5 and the zone z8, the light intensity expressed by the light intensity waveform wn may be approximately kept the same.

As shown in FIG. 3, when the dimming zone d5 is emitting light, but the dimming zone d1 to dimming d4 and the dimming zone d6 to the dimming zone d9 adjacent to the dimming zone d5 do not emit light, the display device 100 may be operated in the peak mode. As shown in FIG. 4, in the peak mode, the light emitted by the dimming zone d2, the dimming zone d5 and the dimming zone d8 may be corresponding to a light intensity waveform wd along the axis X. The light intensity waveform wd may be substantially determined by the light emitted by the dimming zone d5. The light intensity waveform wd may go down at the edges of the zone z5, and the brightness may be lower when approaching to the edges of the zone z5.

In the condition of FIG. 3, an operation voltage of a driving transistor of the dimming zone d5 may be increased to increase the brightness of a light-emitting diode of the dimming zone d5. In this way, the light intensity waveform wd may be pulled up to form a light intensity waveform wp. By enhancing the light intensity to be as expressed by the light intensity waveform wp, the overall brightness may be increased, and the brightness at the edges of the dimming zone d5 may be increased.

Figure 5:
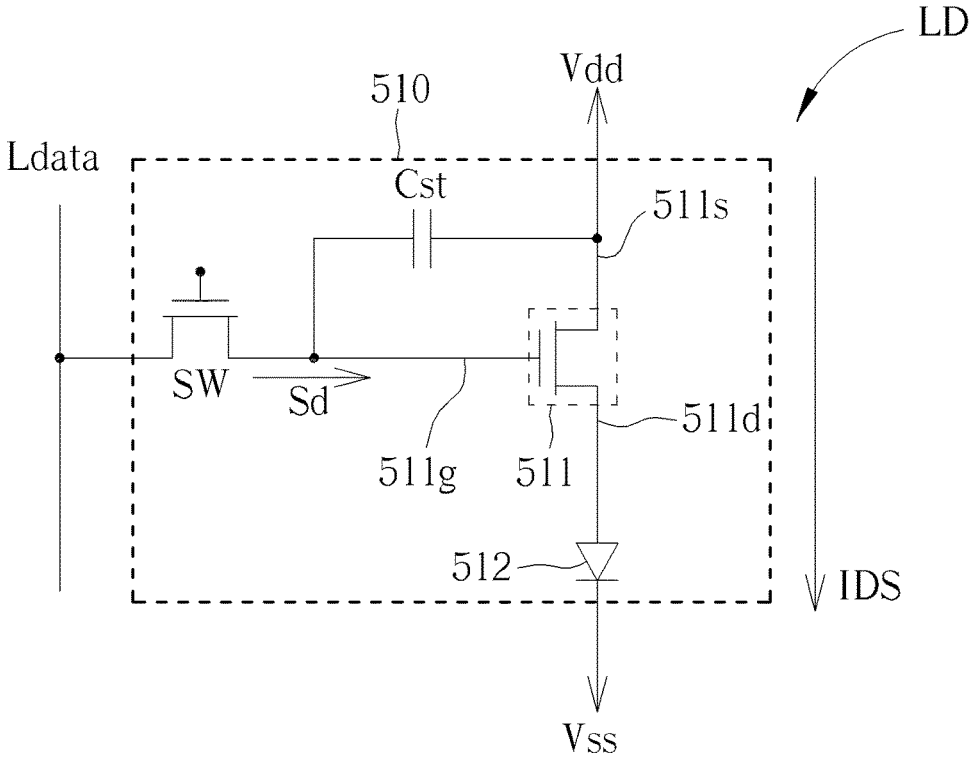
FIG. 5 is a circuit diagram of a light-emitting device according to an embodiment.

However, for performing the peak mode to increase the brightness at the edges of the dimming zone, the operation voltage received by the driving transistor of the dimming zone d5 has to be increased. If the operation voltage is kept at a level of the peak mode, the power consumption may remain high under the normal mode, causing excessive power consumption. Hence, according to embodiments, a variable operation voltage may be provided to reduce the excessive power consumption, and embodiments of the disclosure are not limited thereto. FIG. 5 is a circuit diagram of a light-emitting device LD according to an embodiment. The light-emitting device LD may be disposed in at least one dimming zone of the dimming zone d1 to the dimming zone d9 to emit light. The light-emitting device LD may be a pixel element to display an image. In another embodiment, the light-emitting device LD may be a backlight element to provide backlight for pixel element of a liquid crystal (LC) panel so as to display an image. However, embodiments of the disclosure are not limited thereto.

The light-emitting device LD may include a light-emitting unit 510. The light-emitting unit 510 may include a driving transistor 511 and a light-emitting diode 512. The driving transistor 511 may include a first terminal 511*s*, a second terminal 511*d* and a first gate terminal 511*g*. The first terminal 511*s* may be used to receive an operation voltage Vdd. The light-emitting diode 512 may be coupled to the second terminal 511*d* and used to receive a driving current IDS. The operation voltage Vdd is variable according to an embodiment. The driving transistor 511 may be operated in a saturation region as described below. For example, the light-emitting diode 512 may include an inorganic light-emitting diode, an organic light-emitting diode, a mini light-emitting diode (mini LED), a micro light-emitting diode (micro LED), a quantum dot light-emitting diode (QDLED or QLED), a fluorescence material, a phosphor material, other suitable materials or a combination of the abovementioned element and/or materials; however, embodiments are not limited thereto.

As shown in FIG. 5, the first gate terminal 511*g* may be used to receive a data signal Sd from a data line Ldata. The conductivity of the driving transistor 511 may be controlled according to the data signal Sd. In an embodiment, when the driving transistor 511 has a higher conductivity, the driving current IDS may be larger, and the light intensity of the light-emitting diode 512 may be higher. For example, in the normal mode, the driving current IDS may have a current value In; and in the peak mode, the driving current IDS may have a current value Ip. The current value In may be smaller than the current value Ip (In<Ip). For example, the current value Ip may be larger than two times the current value In, three times the current value In or four times the current value In, but embodiments are not limited thereto. When the driving current IDS is larger, the light intensity of the light-emitting diode 512 may be higher.

Figure 6:
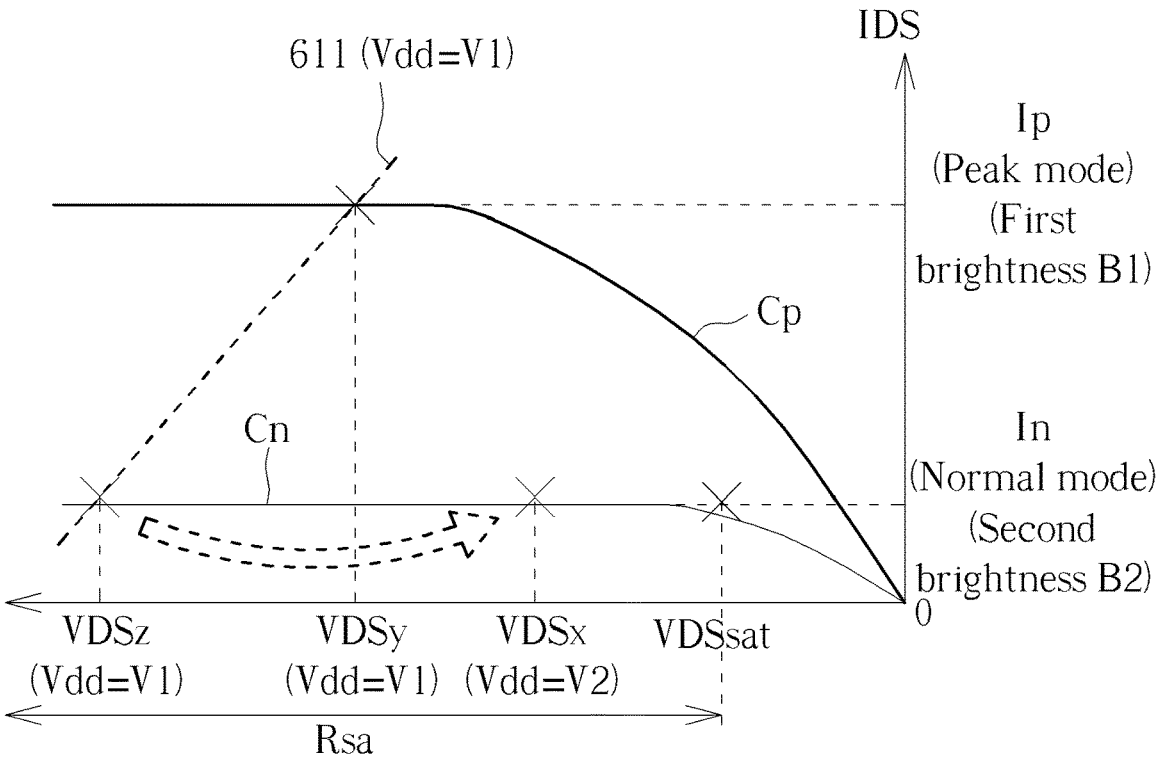
FIG. 6 illustrates the voltages and currents of the driving transistor in FIG. 5.

As shown in FIG. 5 and FIG. 6, when the light-emitting diode 512 is operated to provide a first brightness B1, the operation voltage Vdd may be at a first voltage value V1. When the light-emitting diode 512 is operated to provide a second brightness B2, the operation voltage Vdd may be at a second voltage value V2. The second voltage value V2 may be lower than the first voltage value V1 (V2<V1). The second brightness B2 may be lower than the first brightness B1 (B2<B1). For example, in the normal mode (e.g., FIG. 1), the light-emitting diode 512 may be operated to provide the second brightness B2. In the peak mode (e.g., FIG. 3), the light-emitting diode 512 may be operated to provide the first brightness B1. The second voltage value V2 may be between 1% to 100% of the first voltage value V1 (1%<V2/V1<100%). For example, the second voltage value V2 may be 5%, 10%, 20%, 40%, 60% or 80% of the first voltage value V1, and embodiments are not limited thereto.

The structure of FIG. 5 is merely an example instead of limiting the structure of the light-emitting unit 510. For example, the first terminal 511*s* and the second terminal 511*d* may respectively be a source terminal and a drain terminal of the driving transistor 511. The light-emitting diode 512 may include an anode coupled to the second terminal 511*d* and a cathode coupled to a reference voltage terminal to receive a reference voltage Vss. As shown in FIG. 5, the light-emitting device may further include a capacitor Cst and a switch SW. The capacitor Cst may be coupled between the first terminal 511*s* and the first gate terminal 511*g*. The switch SW may be coupled between the data line Ldata and the first gate terminal 511*g* to control whether the data signal Sd is sent to the first gate terminal 511*g*.

FIG. 6 illustrates the voltages and currents outputted by the driving transistor 511 in FIG. 5. As shown in FIG. 5 and FIG. 6, the horizontal axis of FIG. 6 may be corresponding to a voltage difference between the first terminal 511*s* and the second terminal 511*d*. The vertical axis of FIG. 6 may be corresponding to the driving current IDS of the driving transistor 511. A load line 611 may be a loading reference line of adjusting the voltage difference between the first terminal 511*s* and the second terminal 511*d* when the operation voltage Vdd is equal to the first voltage value V1.

In FIG. 6, a curve Cp may be corresponding to the peak mode, and another curve Cn may be corresponding to the normal mode. Taking FIG. 5 as an example, there may be a voltage difference between the first gate terminal 511*g* and the first terminal 511*s*, and the voltage difference between the first gate terminal 511*g* and the first terminal 511*s* may be adjusted according to the data signal Sd. The curve Cp and the curve Cn may be corresponding to different voltage differences between the first gate terminal 511*g* and the first terminal 511*s*.

According to the load line 611, if the operation voltage Vdd is kept at the first voltage value V1, under the peak mode, the driving current IDS may have the current value Ip and the corresponding voltage difference between the first terminal 511*s* and the second terminal 511*d* may be at a voltage value VDSy; and under the normal mode, the driving current IDS may have the current value In and the corresponding voltage difference between the first terminal 511*s* and the second terminal 511*d* may be at a voltage value VDSz. According to an embodiment, as shown in FIG. 6, the operation voltage Vdd may be adjusted from the first voltage value V1 to be at the second voltage value V2 under the normal mode, and the voltage difference between the first terminal 511*s* and the second terminal 511*d* may be adjusted from the voltage value VDSz to be at a voltage value VDSx. For example, the voltage value VDSz may be larger than the voltage value VDSy (VDSz>VDSy), and the voltage value VDSy may be larger than the voltage value VDSx (VDSy>VDSx).

When the voltage difference between the first terminal 511*s* and the second terminal 511*d* is larger than a voltage value VDSsat, the driving transistor 511 may be operated in the saturation region Rsa. Hence, when the voltage difference between the first terminal 511*s* and the second terminal 511*d* is adjusted from the voltage value VDSz to the voltage value VDSx, the driving current IDS may be maintained to have the current value In. The light intensity of the light emitted by the light-emitting diode 512 in a normal mode may not be affected. In the normal mode, the operation voltage Vdd can be adjusted from the first voltage value V1 to the second voltage value V2 without affecting light intensity, reducing the power consumption to save power.

Figure 7:
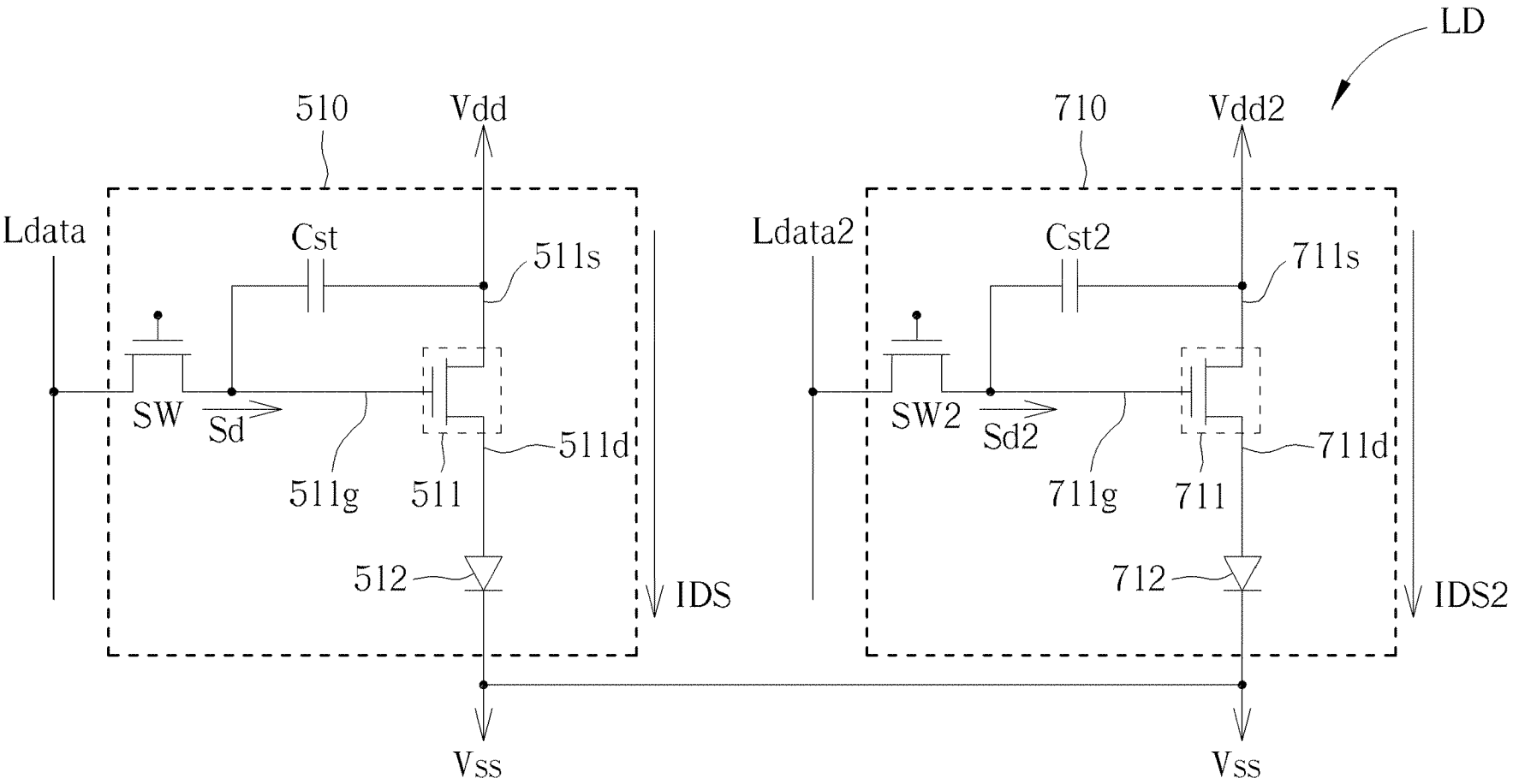
FIG. 7 illustrates a light-emitting device according to another embodiment.

FIG. 7 illustrates a light-emitting device LD according to another embodiment. As shown in FIG. 7, the light-emitting device LD may further include a light-emitting unit 710. The light-emitting unit 710 may include a driving transistor 711 and a light-emitting diode 712. The driving transistor 711 may include a third terminal 711*s*, a fourth terminal 711*d* and a second gate terminal 711*g*. The third terminal 711*s* may be used to receive an operation voltage Vdd2. Like the driving transistor 511, there may be a voltage difference between the third terminal 711*s* and the fourth terminal 711*d* of the driving transistor 711, and another voltage difference between the third terminal 711*s* and the second gate terminal 711*g*. The light-emitting diode 712 may be coupled to the fourth terminal 711*d* to receive a driving current IDS2. The operation voltage Vdd2 may be variable, and the operation voltage Vdd2 may be independent from the operation voltage Vdd. In other words, the operation voltage Vdd and the operation voltage Vdd2 may be set at two different voltage values. For example, when the light-emitting unit 510 is operated in the normal mode or the peak mode, the light-emitting unit 710 may be independently operated in the normal mode or the peak mode without being limited by the operation mode of the light-emitting unit 510.

The light-emitting diode 712 may be coupled to the reference voltage terminal to receive the reference voltage Vss. A cathode of the light-emitting diode 712 may be coupled to the cathode of the light-emitting diode 512. The second gate terminal 711*g* may receive a data signal Sd2 from a data line Ldata2. The light-emitting unit 710 may further include a capacitor Cst2 and a switch SW2, but embodiments are not limited thereto. The structure and operation principles of the light-emitting unit 710 may be similar to that of the light-emitting diode 510, so it is not repeatedly described. FIG. 7 may merely provide an example, and the light-emitting unit 710 may be not limited to the structure shown in FIG. 7. In FIG. 7, it is merely an example for the light-emitting device LD to include two light-emitting units. According to another embodiment, more light-emitting units may be included.

Figure 8:
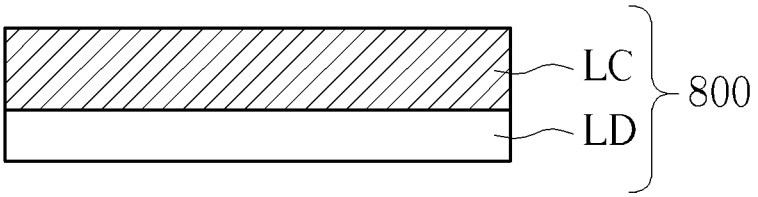
FIG. 8 illustrate a side view of display equipment according to an embodiment.

FIG. 8 illustrate a side view of display equipment 800 according to an embodiment. The display equipment may include the light-emitting device LD and a liquid crystal panel LC. The light-emitting device LD may be as shown in FIG. 5 and FIG. 7, and its structure and operation principles are not repeatedly described. The liquid crystal panel LC may be disposed above the light-emitting device LD. According to the embodiment of FIG. 8, the light-emitting device LD may be used to provide backlight for the liquid crystal panel LC to display images.

Figure 9:
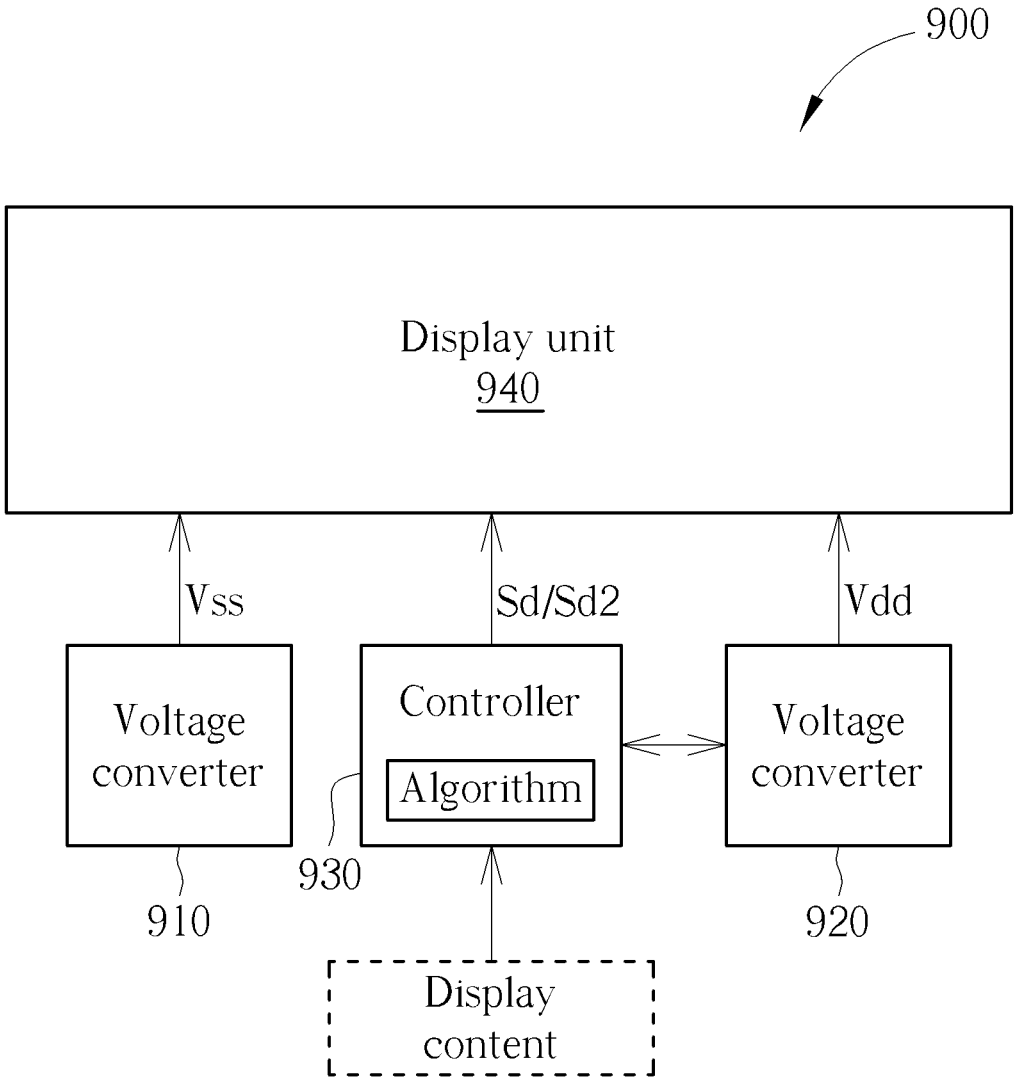
FIG. 9 illustrates a system according to an embodiment.

FIG. 9 illustrates a system 900 according to an embodiment. The system 900 may include a voltage converter 910, a voltage converter 920, a controller 930 and a display unit 940. The voltage converter 910, the voltage converter 920 and the controller 930 may be respectively coupled to the display unit 940. The controller 930 may be coupled to the voltage converter 920. The display unit 940 may the foresaid light-emitting device LD or the display equipment 800 to provide backlight or display images. Each of the voltage converter 910 and the voltage converter 920 may include a DC (direct current) to DC converter, but embodiments are not limited thereto. The voltage converter 910 and the voltage converter 920 may respectively provide the foresaid the reference voltage Vss and the operation voltage Vdd to the display unit 940. The controller 930 may receive display content to provide the data signal to the display unit 940 according to the display content. For example, the said data signal may include foresaid data signal Sd and the data signal Sd2. The controller 930 may control the voltage converter 920 according to the display content to adjust the operation voltage Vdd for the operation voltage Vdd to be at a lower voltage value in the normal mode and at a higher voltage value in the peak mode. The controller 930 may be (but not limited to) a timing controller. An algorithm used to control the operation voltage Vdd may be embedded to the control 930, but embodiments are not limited thereto.

For example, a screen of an in-vehicle computer (a.k.a. carputer) may display a map and a speedometer. In a portion of displaying the map, because displayed patterns may often fill the portion to the full, the condition may be like the normal mode shown in FIG. 1. The operation voltage Vdd and the operation voltage Vdd2 may be set lower, for example, to be at the second voltage value V2. In another portion of displaying the speedometer, the contrast may be higher. For example, white numbers may be displayed on a black background. Hence, the condition may be like the peak mode shown in FIG. 2. The operation voltage Vdd and the operation voltage Vdd2 of the portion of displaying the speedometer may be set higher, for example, to be at the first voltage value V1. The abovementioned screen of an in-vehicle computer is merely an example, and embodiments are not limited thereto.

In summary, a light-emitting device and display equipment provided by embodiments may support operations under the normal mode and the peak mode, the display effect may not be affected, and the power consumption may be reduced.

Those skilled in the art will readily observe that numerous modifications and alterations of the device and method may be made while retaining the teachings of the disclosure.

Accordingly, the above disclosure should be construed as limited only by the metes and bounds of the appended claims.

What is claimed is:

1. A light-emitting device comprising:

a first light-emitting unit, comprising:

a first driving transistor comprising a first terminal, a second terminal and a first gate terminal wherein the first terminal is configured to receive a first operation voltage; and a first light-emitting diode coupled to the second terminal and configured to receive a first driving current; and a second light-emitting unit, comprising:

a second driving transistor comprising a third terminal, a fourth terminal and a second gate terminal wherein the third terminal is configured to receive a second operation voltage; and a second light-emitting diode coupled to the fourth terminal;

wherein the first operation voltage and the second operation voltage are variable, the second operation voltage is independent from the first operation voltage, the first operation voltage is at a first voltage value to operate the first light-emitting diode to provide a first brightness when the second light-emitting diode does not emit light, the first operation voltage is at a second voltage value to operate the first light-emitting diode to provide a second brightness when the second light-emitting diode emits light, and the second voltage value is lower than the first voltage value.

2. The light-emitting device of claim 1, wherein the first gate terminal is configured to receive a data signal from a data line.

3. The light-emitting device of claim 2, further comprising a switch coupled between the first gate terminal and the data line.

4. The light-emitting device of claim 1, wherein the first driving transistor is operated in a saturation region.

5. The light-emitting device of claim 1, further comprising a capacitor coupled between the first terminal and the first gate terminal.

6. The light-emitting device of claim 1, the first light-emitting diode is further coupled to a reference voltage terminal to receive a reference voltage.

7. The light-emitting device of claim 1, wherein a cathode terminal of the first light-emitting diode is coupled to a cathode terminal of the second light-emitting diode.

8. The light-emitting device of claim 1, further comprising a capacitor coupled between the third terminal and the second gate terminal.

9. A display equipment comprising:

a light-emitting device, comprising:

a first light-emitting unit, comprising:

a first driving transistor comprising a first terminal, a second terminal and a first gate terminal wherein the first terminal is configured to receive a first operation voltage; and a first light-emitting diode coupled to the second terminal and configured to receive a first driving current; and a second light-emitting unit, comprising:

a second driving transistor comprising a third terminal, a fourth terminal and a second gate terminal wherein the third terminal is configured to receive a second operation voltage; and a second light-emitting diode coupled to the fourth terminal; and a liquid crystal panel disposed above the light-emitting device;

wherein the first operation voltage and the second operation voltage are variable, the second operation voltage is independent from the first operation voltage, the first operation voltage is at a first voltage value to operate the first light-emitting diode to provide a first brightness when the second light-emitting diode does not emit light, the first operation voltage is at a second voltage value to operate the first light-emitting diode to provide a second brightness when the second light-emitting diode emits light, and the second voltage value is lower than the first voltage value.

10. The display equipment of claim 9, wherein the first gate terminal is configured to receive a data signal from a data line.

11. The display equipment of claim 10, further comprising a switch coupled between the first gate terminal and the data line.

12. The display equipment of claim 9, wherein the first driving transistor is operated in a saturation region.

13. The display equipment of claim 9, further comprising a capacitor coupled between the first terminal and the first gate terminal.

14. The display equipment of claim 9, the first light-emitting diode is further coupled to a reference voltage terminal to receive a reference voltage.

15. The display equipment of claim 9, wherein a cathode terminal of the first light-emitting diode is coupled to a cathode terminal of the second light-emitting diode.

16. The display equipment of claim 9, further comprising a capacitor coupled between the third terminal and the second gate terminal.

* * * * *